US006347720B1

(12) United States Patent
Schley

(10) Patent No.: US 6,347,720 B1
(45) Date of Patent: Feb. 19, 2002

(54) BEVERAGE CAN RESEALABLE LID HAVING ROTATABLE COVER MEMBER AND BIASING PULL TAB

(76) Inventor: Alexander Schley, Hallstädler Strasse 111, D-96052, Bamberg (DE)

( * ) Notice: Subject to any disclaimer, the term of this patent is extended or adjusted under 35 U.S.C. 154(b) by 0 days.

(21) Appl. No.: 09/743,643

(22) PCT Filed: Jul. 12, 1999

(86) PCT No.: PCT/DE99/02121

§ 371 Date: Jan. 10, 2001

§ 102(e) Date: Jan. 10, 2001

(87) PCT Pub. No.: WO00/02785

PCT Pub. Date: Jan. 20, 2000

(30) Foreign Application Priority Data

Jul. 10, 1998 (DE) ..... 288 12 116

(51) Int. Cl.[7] ..... B65D 51/22

(52) U.S. Cl. ..... 220/258; 220/906; 220/269; 220/730

(58) Field of Search ..... 220/254, 255, 220/258, 259, 269, 270, 277, 906, 730

(56) References Cited

U.S. PATENT DOCUMENTS

| | | | | | |
|---|---|---|---|---|---|
| 4,463,866 | A | * | 8/1984 | Mandel | 220/269 |
| 4,673,099 | A | * | 6/1987 | Wells | 220/269 |
| 4,681,238 | A | * | 7/1987 | Sanchez | 220/270 X |
| 4,951,835 | A | * | 8/1990 | DeMars et al. | 220/269 |
| 4,979,635 | A | * | 12/1990 | Levine | 220/269 |
| 5,080,249 | A | * | 1/1992 | Shock | 220/269 |

FOREIGN PATENT DOCUMENTS

| | | | |
|---|---|---|---|
| DE | 4443579 | * | 8/1995 |

* cited by examiner

*Primary Examiner*—Allan N. Shoap
*Assistant Examiner*—Robin A. Hylton
(74) *Attorney, Agent, or Firm*—R. W. Becker & Associates; R. W. Becker

(57) ABSTRACT

A resealable lid for beverage cans is provided. The can has a press-in tab for opening the pouring opening thereof via a press-in tip. A rotating lid is secured to the same pin or rivet as the press-in tab, and is rotatable over the pouring opening. When the rotating lid is over the pouring opening, and the press-in tab is pulled up, a support leg thereof catches against an arresting member on the surface of the can. In the catching position of the leg, the press-in tip of the press-in tab presses the rotating lid against the pouring opening.

2 Claims, 1 Drawing Sheet

BEVERAGE CAN RESEALABLE LID HAVING ROTATABLE COVER MEMBER AND BIASING PULL TAB

BACKGROUND OF THE INVENTION

The present invention relates to a resealable lid for beverage cans, and in particular a sealing system for beverage cans.

A known beverage can sealing system having a resealable beverage can lid (DE-U-90 05 150) comprises a press-in tab, whereby a rotating lid is secured below the press-in tab on the same pin or rivet as the press-in tab, and whereby when the can is opened the rotating lid can be rotated into a closing position over the pouring opening. The beverage contents are thus protected against dirt and insects entering from the outside. In addition, none or only a small portion of the liquid contents can spill or splash out of the pouring opening when the can is moved.

Since in the closing position the rotating lid exerts only slight pressure upon the rim of the pouring opening, it is not possible to achieve a fluid tight and gas tight resealing of the beverage can.

It is therefore an object of the present invention to improve the resealing function.

SUMMARY OF THE INVENTION

This objective is realized by a sealing system for a beverage can that includes a press-in tab for opening a pouring opening of the can via a press-in tip of the press-in tab, wherein the press-in tab is also provided with a support leg; and a rotating lid that is secured to a pin or rivet to which the press-in tab is also secured, wherein the rotating lid is rotatable over an open pouring opening, wherein when the rotating lid is over such an opening, the support leg, with the press-in tab pulled up, is adapted to catch against an arresting member that is disposed on a surface of the can, wherein in a catching position of the leg, the press-in tip of the press-in tab presses the rotating lid against the pouring opening.

With the claimed support or leg in the press-in tab, it is possible by means of the press-in tip of the press-in tab to apply a sealing pressure upon the rotating lid in its sealing position, as a consequence of which it is possible to achieve a fluid tight and gas tight resealing of the can. The sealing effect is improved even further if the rotating lid is inherently stable and is coated with a sealing material. In addition, the sealing means is easy to operate and can be repeated, and is economical to produce. In addition to providing protection of the beverage against insects and dirt, a resealing to protect against leaking out is provided, as a result of which in addition the drink remains fresh for a longer period of time.

BRIEF DESCRIPTION OF THE DRAWING

The present invention will be described in detail with the aid of a drawing. It shows.

DESCRIPTION OF PREFERRED EMBODIMENTS

Figure 1:
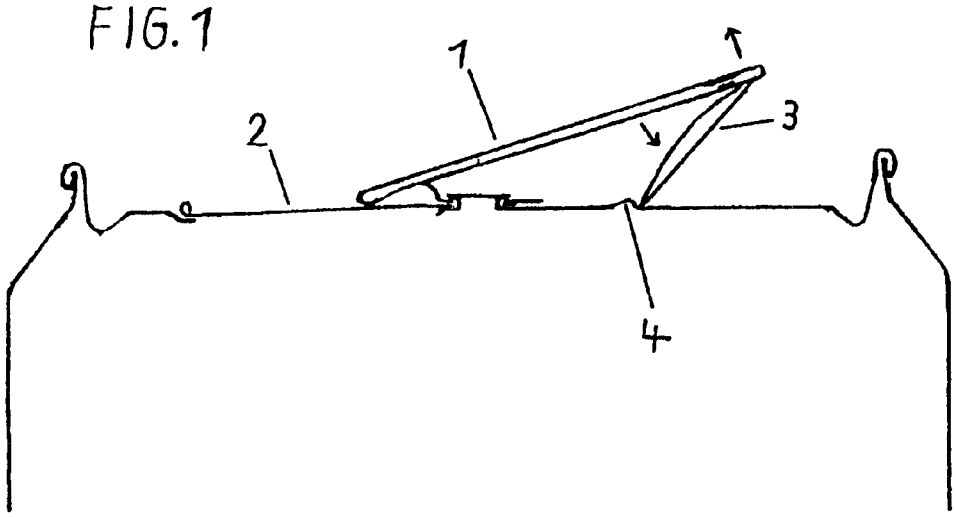
FIG. 1 a side view of a resealable beverage can lid in the sealing position of a rotating lid, and FIG. 2 a corresponding plan view with the rotating lid opened.
Figure 2:
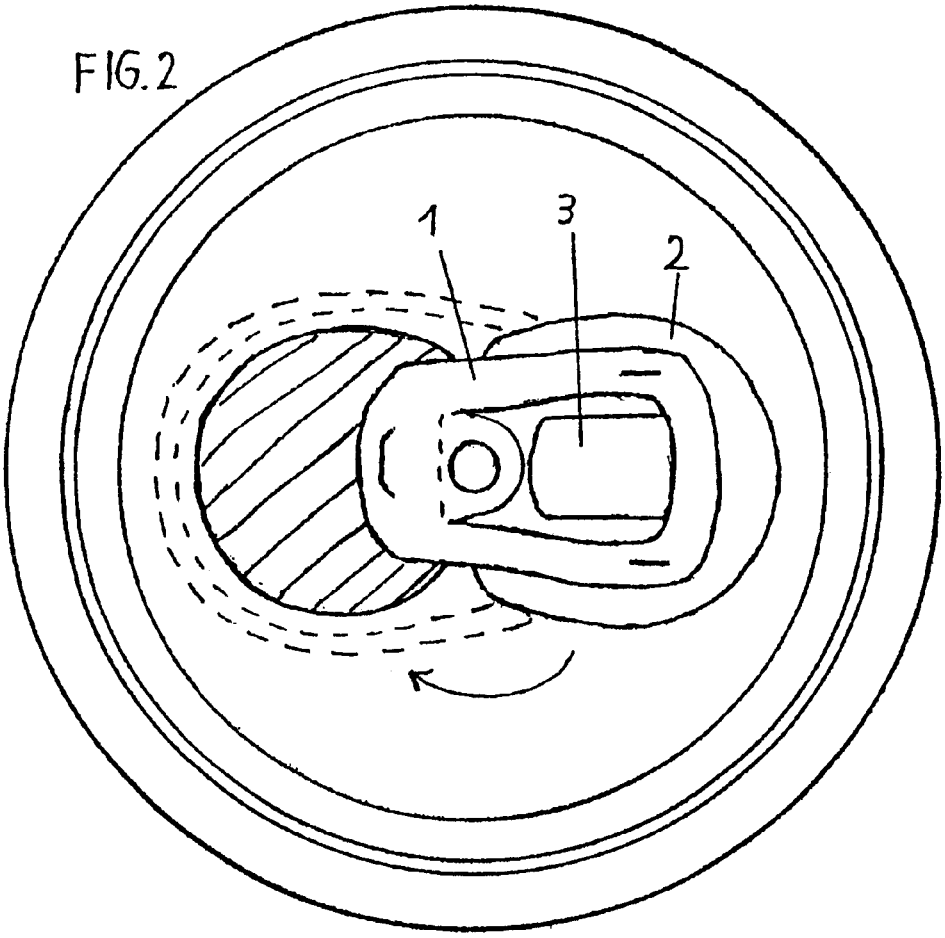

With the inventive closure or sealing system, beverage cans having a press-in opening can be resealed. In comparison to conventional cans, the inventive can is additionally provided with a rotating lid (2) under the press-in tongue or tab (1) which in turn is provided with a "hinged" support leg (3). To open the can, one pulls the tab (1) (as previously known), whereupon the oppositely disposed scored piece of metal is pressed into the can. The can is now opened, and one can drink therefrom. In many situations the contents of the can are not immediately emptied, or should be protected against insects or dirt. To seal the can, one rotates over the pouring opening the rotating lid (2) that is disposed below the tab (1) (rotates about the same rivet or pin as does the tab). Due to the spring effect of the tab extension, the press-in tip of the tab (1) now presses somewhat upon the rotating lid (2) and thus protects the beverage from insects. One now pulls the tab (1) up slightly until the leg (3) presses downwardly and catches in the stop or arresting lug or projection (4). In this position, the press-in tip of the tab (1) presses with great pressure upon the inherently stable rotating lid (2), which is coated with sealing material, and thereby seals the can against dirt, leaking out, and gas. In order to again open the can, the tab (1) is rotated slightly to the side until the leg (3) is released from the arresting lug (4) and the rotating lid (2) can again be rotated to the side.

The specification incorporates by reference the disclosure of German priority document 298 12 116.6 filed Jul. 10, 1999 and international priority document PCT/DE99/02121 filed Jul. 12, 1999.

The present invention is, of course, in no way restricted to the specific disclosure of the specification and drawings, but also encompasses any modifications within the scope of the appended claims.

What I claim is:

1. A sealing system for a beverage can comprising:

a press-in tab (1) for opening a pouring opening of said can via a press-in tip of said press-in tab, wherein said press-in tab (1) is also provided with a support leg (3); and a rotating lid (2) that is secured to a pin or rivet to which said press-in tab (1) is also secured, wherein said rotating lid (2) is rotatable over an open pouring opening, wherein when said rotating lid is over said pouring opening, said leg (3), with said press-in tab (1) pulled up, is adapted to catch against an arresting member (4) that is disposed on a surface of said can, wherein in a catching position of said leg (3), said press-in tip of said press-in tab (1) presses said rotating lid (2) against said pouring opening.

2. A sealing system for a beverage can according to claim 1, wherein said rotating lid (2) is inherently stable and is coated with a sealing material.

* * * * *